US009981166B2

(12) United States Patent
Samson et al.

(10) Patent No.: US 9,981,166 B2
(45) **Date of Patent: *May 29, 2018**

(54) GOLF CLUB HEAD

(71) Applicant: DUNLOP SPORTS CO. LTD., Kobe-shi, Hyogo (JP)

(72) Inventors: Mitchell Samson, Huntington Beach, CA (US); Alex L. Timmons, Huntington Beach, CA (US)

(73) Assignee: DUNLOP SPORTS CO. LTD., Kobe (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/385,221

(22) Filed: Dec. 20, 2016

(65) Prior Publication Data

US 2017/0100648 A1 Apr. 13, 2017

Related U.S. Application Data

(63) Continuation of application No. 14/619,938, filed on Feb. 11, 2015, now Pat. No. 9,561,409, which is a continuation of application No. 13/750,611, filed on Jan. 25, 2013, now Pat. No. 8,979,672.

(51) Int. Cl.
*A63B 53/04* (2015.01)

(52) U.S. Cl.
CPC .. *A63B 53/0466* (2013.01); *A63B 2053/0408* (2013.01); *A63B 2053/0462* (2013.01)

(58) Field of Classification Search
CPC .... A63B 2053/0462; A63B 2053/0408; A63B 53/0466
See application file for complete search history.

(56) References Cited

U.S. PATENT DOCUMENTS 6,319,150 B1 11/2001 Werner et al.
6,390,933 B1 5/2002 Galloway et al.
6,623,377 B2 * 9/2003 Evans ..... A63B 53/02 473/329

(Continued)

OTHER PUBLICATIONS

"TaylorMade Burner SuperFast 2.0 Driver Review," <http://www.golfalot.com/equipment-reviews/taylormade/burner-superfast-20-driver-6293.aspx>, Accessed on Jan. 25, 2013.

(Continued)

*Primary Examiner* — John E Simms, Jr.
(74) *Attorney, Agent, or Firm* — Oliff PLC

(57) ABSTRACT

A wood-type golf club head includes a main body and a striking wall associated with the main body. The striking wall has a striking face including a face center, a first imaginary plane tangent to the face center, and a rear surface opposite the striking face. In a second imaginary plane perpendicular to the first imaginary plane and passing through the face center, the striking face includes a first point associated with a maximum thickness, $t_{max}$, of the striking wall, and a second point associated with a minimum thickness, $t_{min}$, of the striking wall, such that a ratio, $t_{max}/t_{min}$, is no less than 1.70. Also, in the second imaginary plane, the striking wall gradually tapers in thickness entirely from the first point to the second point.

20 Claims, 9 Drawing Sheets

(56) References Cited

U.S. PATENT DOCUMENTS 6,652,391 B1 11/2003 Kubica et al.
8,070,623 B2 12/2011 Stites et al.
8,075,421 B2 12/2011 Hirano
8,096,897 B2 1/2012 Beach et al.
8,133,135 B2 3/2012 Stites et al.
8,152,652 B2 4/2012 Curtis et al.
8,157,670 B2 4/2012 Oldknow et al.
8,167,737 B2 5/2012 Oyama
8,172,697 B2 5/2012 Cackett et al.
8,187,116 B2 5/2012 Boyd et al.
8,187,118 B2 5/2012 Matsunaga et al.
8,197,356 B2 6/2012 Curtis et al.
8,197,357 B1 6/2012 Rice et al.
8,197,358 B1 6/2012 Watson et al.
8,210,961 B2 7/2012 Finn et al.
8,214,992 B2 7/2012 Hirano
8,216,087 B2 7/2012 Breier et al.
8,216,089 B2 7/2012 Matsunaga et al.
8,221,260 B2 7/2012 Stites et al.
8,221,261 B2 7/2012 Curtis et al.
8,226,498 B2 7/2012 Stites et al.
8,226,500 B2 7/2012 Yamamoto et al.
8,231,481 B2 7/2012 Takechi
2002/0049094 A1* 4/2002 Kosmatka ..... A63B 53/04 473/329
2002/0068646 A1 6/2002 Yoneyama
2002/0160856 A1* 10/2002 Evans ..... A63B 53/0487 473/342
2005/0020379 A1 1/2005 Kumamoto
2005/0101407 A1 5/2005 Hirano
2005/0209019 A1* 9/2005 Schweigert ..... A63B 53/0466 473/329
2007/0054750 A1 3/2007 Rice
2008/0009369 A1* 1/2008 Yokota ..... A63B 53/0466 473/349
2009/0082134 A1 3/2009 Matsunaga et al.
2009/0163291 A1* 6/2009 Chao ..... A63B 53/0466 473/342
2009/0286622 A1 11/2009 Yokota
2010/0197424 A1* 8/2010 Beach ..... A63B 53/02 473/307
2010/0234135 A1* 9/2010 Matsunaga ..... A63B 53/0466 473/342
2011/0152005 A1 6/2011 Curtis et al.
2011/0281667 A1 11/2011 Soracco
2011/0287854 A1 11/2011 Rice et al.
2011/0306439 A1 12/2011 Lin et al.
2011/0319190 A1 12/2011 Wada et al.
2012/0004047 A1 1/2012 Meyer et al.
2012/0010020 A1 1/2012 Golden et al.
2012/0064994 A1 3/2012 Wada et al.
2012/0083361 A1 4/2012 Beach et al.
2012/0108359 A1 5/2012 Abe
2012/0129627 A1 5/2012 Hirano
2012/0135821 A1 5/2012 Boyd et al.
2012/0135822 A1 5/2012 Deshmukh et al.
2012/0142447 A1 6/2012 Boyd et al.
2012/0149495 A1 6/2012 Wada et al.
2012/0157227 A1 6/2012 Morin et al.
2012/0165117 A1 6/2012 Abe
2012/0165118 A1 6/2012 Stites et al.
2012/0172145 A1 7/2012 Kato
2012/0184394 A1 7/2012 Boyd
2012/0190479 A1 7/2012 Rice et al.
2012/0214611 A1* 8/2012 Myrhum ..... A63B 53/0466 473/330

OTHER PUBLICATIONS

"Cleveland Golf—Classic 270 Driver," <http://www.clevelandgolf.com/US_classic-270-driver_classic_270_driver_viewProd_drivers.html>, Accessed on Jan. 25, 2013.
"Cleveland Golf—CG Black Driver," <http://www.clevelandgolf.com/US_cg-black-driver_cg_black_driver_viewProd_drivers.html>, Accessed on Jan. 25, 2013.
Dec. 9, 2015 Office Action issued in U.S. Appl. No. 14/619,938.
Apr. 22, 2016 Office Action issued in U.S. Appl. No. 14/619,938.

* cited by examiner

GOLF CLUB HEAD

This is a Continuation of application Ser. No. 14/619,938, filed Feb. 11, 2015, which is a Continuation of application Ser. No. 13/750,611, filed Jan. 25, 2013 (now U.S. Pat. No. 8,979,672 B2 issued Mar. 17, 2015). The prior applications, including the specifications, drawings and abstract are incorporated herein by reference in their entirety.

BACKGROUND OF THE INVENTION

The present invention pertains generally to golf clubs and, more particularly, to golf club heads that include uniquely configured striking walls of non-uniform thickness.

Some conventional club heads (e.g. drivers and fairway woods) have hollow shells usually made of a metal such as steel, aluminum or titanium. These hollow shells have relatively thin walls, including a thin striking wall which defines a striking face used to impact a golf ball.

The use of hollow-type metal golf club heads has made the game of golf easier for the average golfer by enabling the club head to achieve a higher moment of inertia and coefficient of restitution (COR). For example, the increased size of a hollow-type metal club head generally results in the club head having a higher moment of inertia, which assists in maintaining the stability of the golf club through impact by mitigating head twist resulting from an off-center golf ball strike. In addition, the use of metal hollow-type golf club heads enables increased COR of the striking wall as a result of a greater ability to configure the striking wall to deflect during impact with a golf ball.

Golf club designers have pushed the performance boundaries of golf club heads even further by varying the thicknesses of the striking walls thereof. Along these lines, it is generally known to those skilled in the art in the design of golf club heads that reducing thickness at selected locations along the striking wall of the golf club head may enhance club performance by, among other things, increasing maximum COR and increasing the amount of discretionary mass. Nonetheless, conventional methods of configuring striking walls to improve performance fail to account for the effect of non-uniform thickness on the stress profile of the striking wall. Particularly, non-uniform thickness striking walls, in the manner that they vary, tend to generate, or insufficiently mitigate, high stress regions that may be susceptible to failure.

SUMMARY OF THE INVENTION

In accordance with the present invention, the below examples are discussed in relationship with a wood-type golf club head for the sake of illustration. However, these principles may be applicable to other types of golf club heads including hybrids, etc.

A wood-type golf club head according to an example of the invention may include a main body and a striking wall associated with the main body. The striking wall defines a striking face that includes a face center, a striking face perimeter, and is substantially coplanar with a virtual striking face plane. In a virtual plane passing through the face center and perpendicular to the virtual striking face plane, the striking face has a face length L and the striking wall has a minimum thickness, $t_{min}$, and a maximum thickness, $t_{max}$. A first thickness region is the locus of locations on the striking face that are each associated with a thickness no less than $0.92*t_{max}$. A ratio $t_{max}/t_{min}$ is no less than 1.70. The first thickness region extends outward from the face center by a maximum distance $D_1$ that is no greater than 0.13*L.

In another example of the present invention, a wood-type golf club head may include a main body and a striking wall associated with the main body. The striking wall defines a striking face that includes a face center, a striking face perimeter, and is substantially coplanar with a virtual striking face plane. In a virtual plane that passes through the face center and is perpendicular to the virtual striking face plane, the striking face has a face length L and the striking wall has a first thickness associated with the face center, $t_{fc}$, that is no less than 4.25 mm. A second thickness, associated with a point on the striking face located no more than $0.16*L_h$ from the face center, is no greater than $0.90*t_{fc}$.

In another example of the present invention, a wood-type golf club head comprises a main body and a striking wall associated with the main body. The striking wall defines a striking face that includes a face center, a point spaced from the face center, and is generally coplanar with a virtual striking face plane. A first COR value, measured at the face center, is less than 0.83, and a second COR value, measured at the point spaced from the face center, is greater than the first COR value. A striking wall thickness associated with the point is no greater than 4.0 mm.

In another example of the present invention, a wood-type golf club head comprises a main body and a striking wall associated with the main body. The striking wall has a striking face including a face center, a first imaginary plane tangent to the face center, and a rear surface opposite the striking face. In a second imaginary plane perpendicular to the first imaginary plane and passing through the face center, the striking face includes, specific to the second imaginary plane, a first point associated with a maximum thickness, $t_{max}$, of the striking wall, and a second point associated with a minimum thickness, $t_{min}$, of the striking wall, such that a ratio, $t_{max}/t_{min}$, is no less than 1.70. The striking wall gradually tapers in thickness entirely from the first point to the second point.

In another example of the present invention, the striking wall may include a central region having the face center residing thereon and defining a minimum COR point, and a peripheral region which circumvents the central region and defines a maximum COR point. The striking wall may be shaped such that a deviation between the COR values of the striking wall corresponding to an impact of the striking face with a golf ball at the maximum COR point relative to the COR corresponding to an impact at the minimum COR point is greater than about 0.004. Additionally, the COR corresponding to an impact at the minimum COR point may not be less than about 0.825. Further, the striking wall may have a COR ratio equal to the COR corresponding to an impact at the maximum COR point divided by the COR corresponding to an impact at the minimum COR point, the restitution ratio being in the range of from about 1.006 to about 1.008. Further, the central region may extend no more than about 0.25 inches radially from an axis passing through the face center and generally perpendicular to the virtual striking face plane tangent to the striking face at the face center. The minimum COR point may also be at the face center. In each of the aforementioned examples, at least a portion of the main body may be formed of a material having an elongation of at least 10%.

The various exemplary aspects described above may be implemented individually or in various combinations. These and other features and advantages of the golf club head according to the invention in its various aspects and demonstrated by one or more of the vari ous examples will become apparent after consideration of the ensuing description, the accompanying drawings, and the appended claims.

BRIEF DESCRIPTION OF THE DRAWINGS

The drawings described below are for illustrative purposes only and are not intended to limit the scope of the present invention in any way. Exemplary implementations will now be described with reference to the accompanying drawings, wherein:

FIG. 5(*a*) is a partial cross-sectional view of the golf club head of FIG. 1 taken along the plane 5-5;

FIG. 5(*b*) is a partial cross-sectional view of the golf club head of FIG. 1 taken along the plane 5-5;

FIG. 6(*a*) is a partial cross-sectional view of the golf club head of FIG. 1 taken along the plane 6-6;

FIG. 6(*b*) is a partial cross-sectional view of the golf club head of FIG. 1 taken along the plane 6-6.

DETAILED DESCRIPTION OF TOE INVENTION

Figure 1:
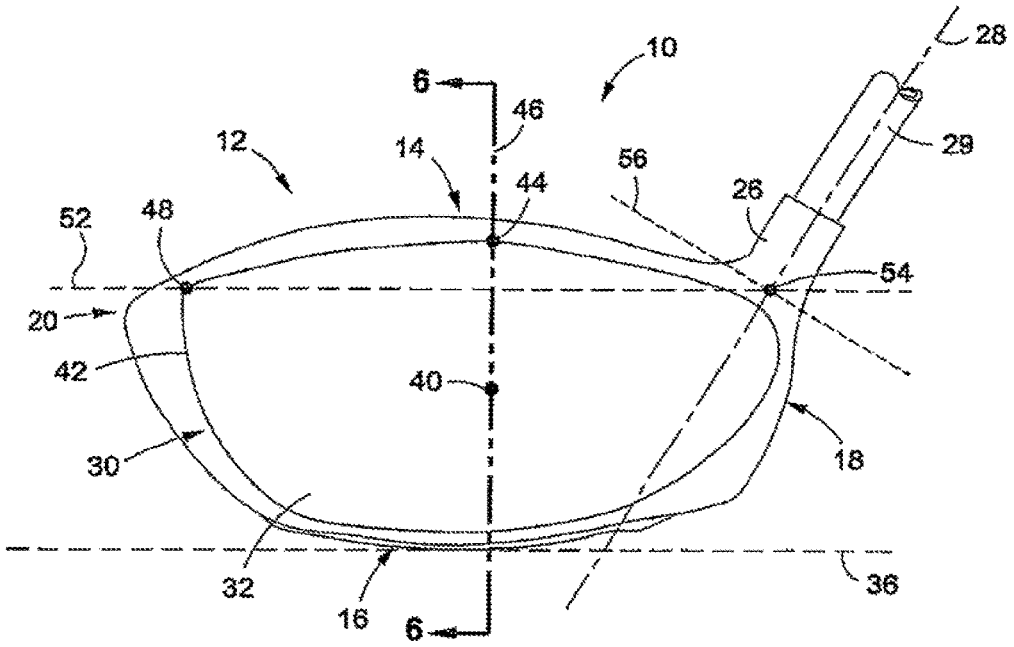
FIG. 1 is a front elevational view of a golf club head according to one or more aspects of the present invention.

Referring now to the drawings wherein the showings are for purposes of illustrating various aspects of the present invention only, and not for purposes of limiting the same, FIGS. 1-6(*b*) depict a golf club head 10 constructed in accordance with the present invention. In one or more aspects of the present invention, and as depicted by example in FIGS. 1-6(*b*), the golf club head 10 is a head for a wood-type golf club, such as driver or a fairway wood. However, as indicated above, those of ordinary skill in the art will recognize that the principles of the present invention, as will be described in more detail below, may be applicable to other types of golf club heads including hybrids, etc.

The golf club head 10 includes a main body 12. When viewed from the perspectives shown in FIGS. 1 and 3, the main body 12 includes a top portion 14 and a bottom portion 16 which is generally opposite the top portion 14. The main body 12 also includes a heel portion 18, a toe portion 20 which is generally opposite the heel portion 18, a front portion 22, and a rear portion 24 that is generally opposite the front portion 22. Still further, the main body 12 includes a hosel 26 which, as is seen in FIGS. 1 and 3, is generally located at the heel side of the top portion 14 proximate the front portion 22. The hosel 26 is adapted to receive a shaft 29, a portion of such shaft 29 being shown in FIGS. 1 and 2. In alternative embodiments, the club head 10 is "hoselless," such that e.g. a shaft is associated with a recess located in the top portion 14 of the club head 10. The hosel 26 defines a central axis, or centerline, 28 which is also shown in FIG. 1.

The golf club head 10 further comprises a striking wall 30 which is associated with the main body 12. In some embodiments, the striking wall 30 is integrally (i.e. unitarily) connected to the main body 12. However, preferably, in some embodiments, the striking wall 30 comprises a discrete element coupled to a peripheral support surface that is itself integrally connected to the top, bottom, heel and toe portions 14, 16, 18, 20 of the main body 12. In any embodiment of the golf club head 10 wherein the striking wall 30 is formed as a discrete element, the attachment thereof to either the top, bottom, heel and toe portions 14, 16, 18, 20 of the main body 12 or the aforementioned peripheral support surface may be facilitated by, for example, mechanical interlocking (e.g. press-fitting or expansion-fitting), welding, brazing, or adhesive bonding.

The main body 12 and/or striking wall 30 may comprise a metallic and/or non-metallic material, e.g., stainless steel, titanium, or fiber-reinforced plastic. Preferably, the main body 12 and the striking wall 30 each comprise titanium or titanium alloy. More preferably, the striking wall 30 is composed essentially of a low-density titanium alloy, e.g. titanium 8-1-1 or titanium 3-1-1, and the main body 12 is composed essentially of titanium 6-4. However, in alternative embodiments, the main body 12 is formed of discrete portions having different compositions. For example, in some embodiments, the bottom portion 16 of the main body 12 comprises a metallic material, e.g. titanium 6-4, and the top portion 14 comprises a fiber-reinforced polymer or other composite material. Such a construction may advantageously decrease the height of the center of gravity of the club head 10, or better position the center of gravity of the club head 10 (as projected onto the front surface of the club head 10) to increase the overall area of the region of the front surface having a high COR. However, forming the top portion 14 of a composite material may increase manufacturing costs and/or cause the club head 10 to have disadvantageous acoustic or vibration-emanation properties.

The main body 12, in some embodiments, is at least partially cast. By forming the main body 12 by casting, internal ribs (particularly proximate the front portion 22) may be cast-in that stiffen the front portion 22 proximate a central region, permitting an increased region of high COR, while managing regions anticipated to incur high stress at impact. Specifically, such internal ribs, in some embodiments are located at a junction between, and thus bridge, the front portion 22 and the top portion 14. However, casting may be a relatively expensive manufacturing process. Thus, more preferably, at least a portion of the main body 12 is formed by stamping (or other forging operation).

As discussed above, preferably at least a portion of the club head 10 is formed by forging, particularly stamping. Preferably, at least the bottom portion 16 (e.g. the sole) is stamped. Most preferably, the bottom portion 16 and the top portion 20 are stamped and subsequently coupled to each other by welding. To facilitate stamping (or bending, pressing, or another similar, suitable forging technique), the bottom portion 16 (and optionally the top portion 20) is formed of a material having an elongation greater than or equal to about 10%.

As employed herein, the phrases "greater than or equal to" and "not less than" may be used interchangeably. Similarly, the phrases "less than or equal to" and "not greater than" may be used interchangeably.

The golf club head 10 preferably has a volume no less than 120 cc, more preferably no less than 320 cc, even more preferably no less than 400 cc and most preferably within the range of between about 410 cc and about 470 cc. Preferably, the club head 10 includes a loft angle no greater than 22°, more preferably no greater than 15°, and most preferably within the range of about 9° to about 14°. The club head also includes a lie angle within the range of about 58° to about 62°.

Figure 5:
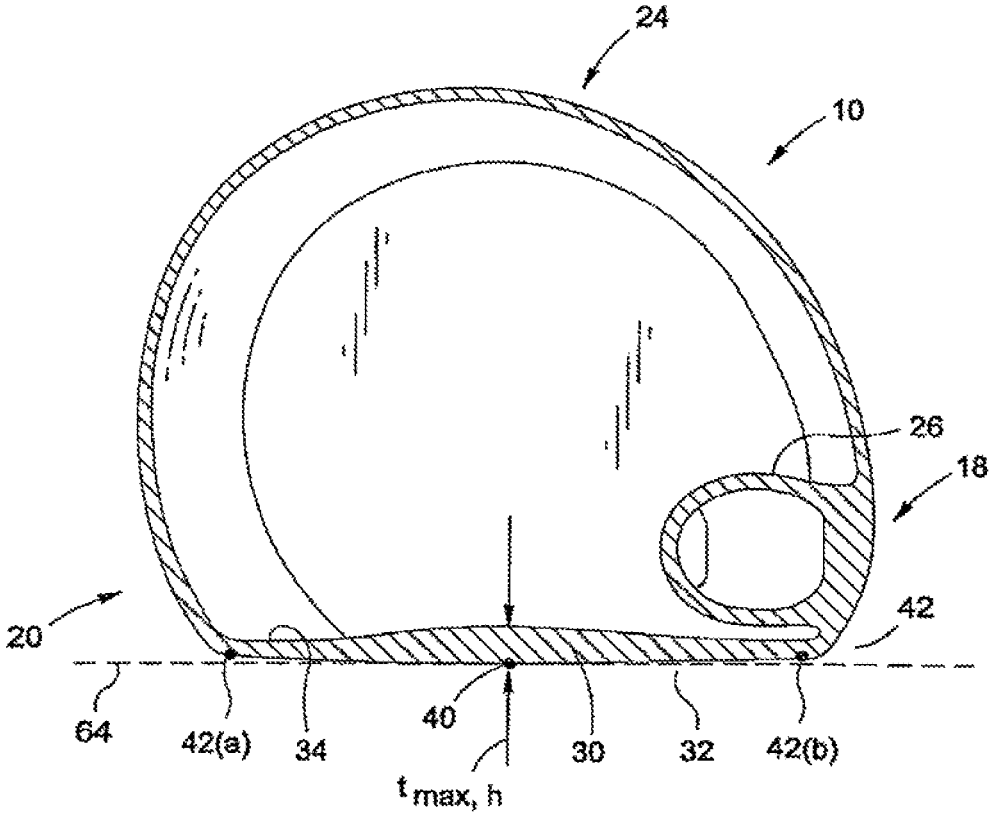
FIG. 5 is a cross-sectional view of the golf club head of FIG. 1 taken along the plane 5-5 of FIG. 3.
Figure 5A:
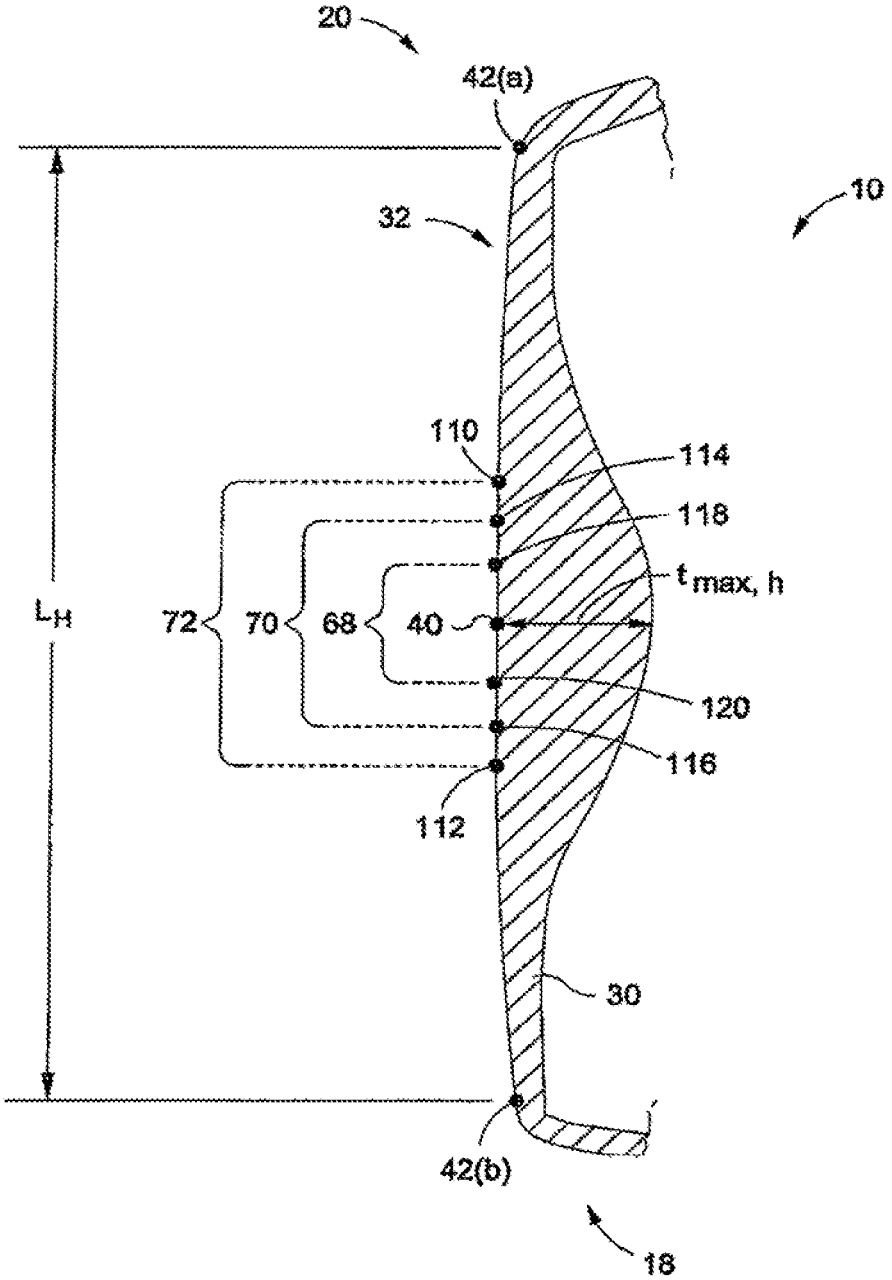
Figure 5B:
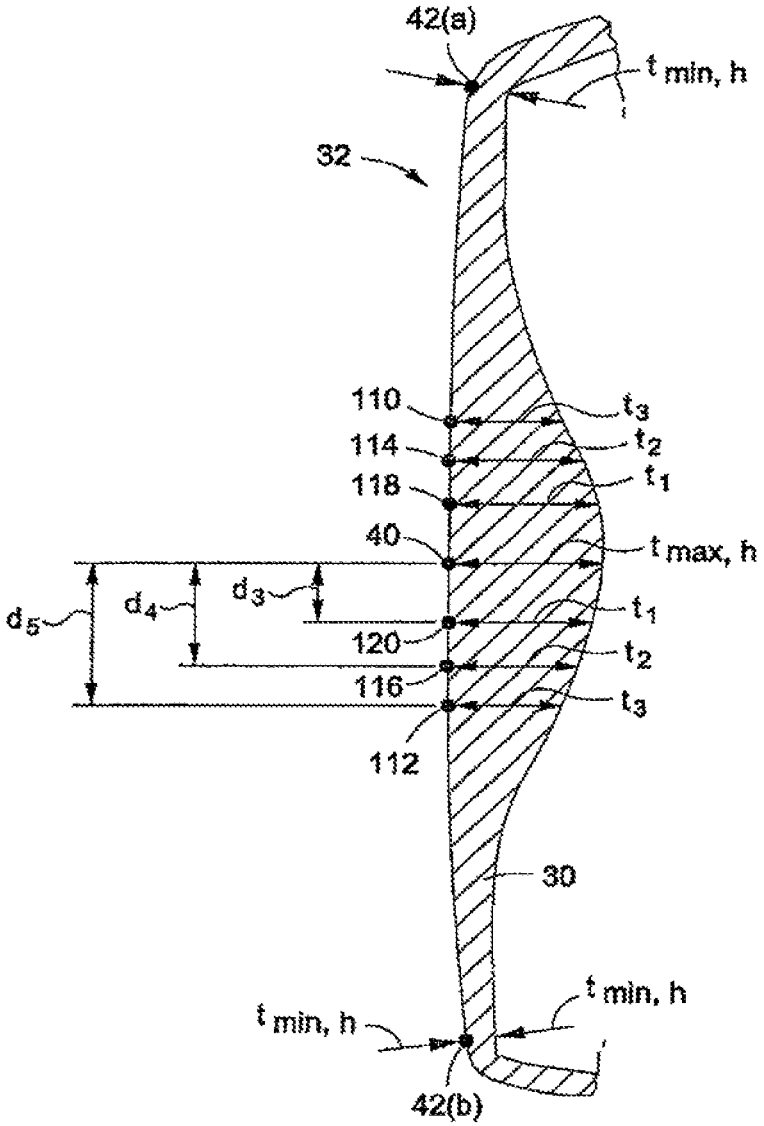

The golf club head 10 delimits an exterior, generally planar striking face 32 suitable for striking a golf ball, and an opposed rear surface 34 (see e.g. FIG. 5). Those of ordinary skill in the art will recognize that though the striking face 32 is referred to as being generally planar, in one or more aspects of the invention, it may possess bulge and/or roll of a constant or variable radius that are customary in a wood-type club (e.g. a radius within the range of about 9 in. to about 15 in.). Alternatively, the striking face 32 may be essentially flat, as in a conventional iron-type golf club.

In FIGS. 1 and 3, the golf club head 10 is depicted as being in a "reference position." As used herein, "reference position" denotes a position of a club head, e.g. club head 10, wherein the bottom portion 16 of the club head 10 rests on an imaginary ground plane 36 such that the hosel centerline 28 lies in an imaginary vertical hosel plane 38 that contains an imaginary horizontal line 38*a* (shown in FIG. 3) generally parallel to the striking face 32. Unless otherwise indicated, all parameters herein are specified with the golf club head 10 in the reference position.

The striking face 32 defines a face center 40 and a striking face perimeter 42. The striking face 32 also defines a center apex 44. The center apex 44 denotes the point of intersection between a vertical first virtual plane 46 (coincident with cross-section 6 of FIG. 1), which is perpendicular to the imaginary vertical hosel plane 38 and passes through the face center 40 and the striking face perimeter 42 proximate the top portion 14 (with the golf club head 10 in the reference position). As such, the center apex 44 constitutes a point on the striking face perimeter 42.

The striking face 32 further defines a toe point 48. "Toe point," e.g. toe point 48, as used herein, denotes the furthest laterally projecting point of the striking face 32 proximate the toe portion 20. As with the center apex 44, the toe point 48 constitutes a point on the striking face perimeter 42. An imaginary horizontal plane 52 passing through the toe point 48 intersects the hosel centerline 28 at a point 54. The above-described hosel 26 is delimited from the remainder of the main body 12 by an imaginary plane 56 which is normal to the hosel centerline 28 and contains the point 54.

Figure 2:
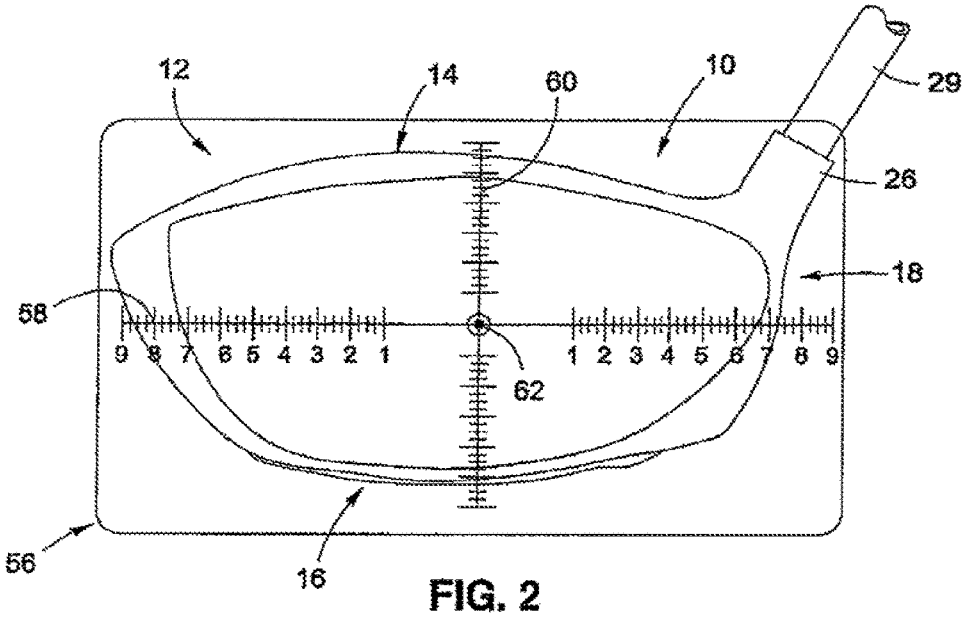
FIG. 2 is a front elevational view similar to FIG. 1, but further depicting a measurement template superimposed upon the striking face of the golf club head.
Figure 3:
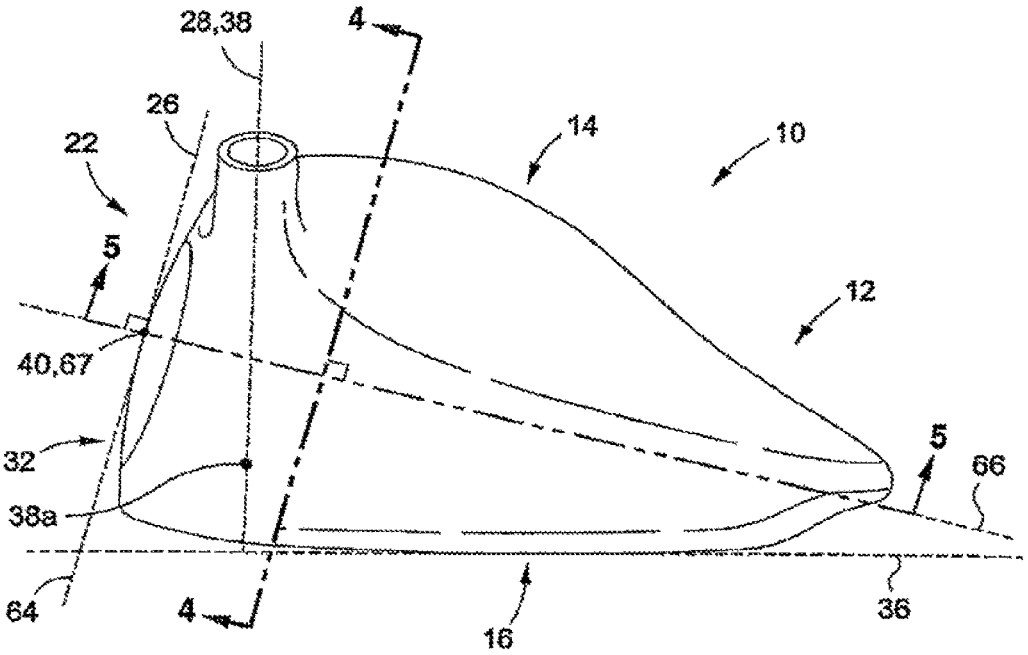
FIG. 3 is a heel side elevational view of the golf club head shown in FIG. 1.

The face center 40, as used herein, is located using a template 56 which is shown in FIG. 2. The template 56 has a coordinate system with a heel-toe axis 58 orthogonal to a top-bottom axis 60. An aperture 62 is disposed at the origin of the coordinate system, with the axes 58, 60 being graduated into evenly spaced increments. The template 56 may be made of a flexible material, e.g., a transparent polymer. The location of the face center 40 is determined by initially applying the template 56 to the striking face 32 so that the aperture 62 is approximately in the middle of the striking face 32 and the heel-toe axis 58 is generally horizontal. The template 56 is then translated in the heel-toe direction along the striking face 32 until the heel and toe measurements along the axis 58 at opposite points on the striking face perimeter 42 of the striking face 32 proximate respective ones of the heel and toe portions 18, 20 have the same absolute value. Once the template 56 is centered with respect to the striking face 32 in the heel-toe direction, the template 56 is translated into the top-bottom direction along the striking face 32 until the measurements along the axis 60 at opposite points on the striking face perimeter 42 of the striking face 32 proximate respective ones of the top and bottom portions 14, 16 have the same absolute value. The above sequence is repeated until the absolute value of the heel measurement along the axis 58 is equal to that of the toe measurement and the absolute value of the bottom measurement along axis 60 is equal to that of the top measurement. A point is then marked on the striking face 32 through the aperture 62 to designate the face center 40. A locating template, such as the template 56, is referenced in the United States Golf Association's Procedure for Measuring the Flexibility of a Golf Cluhhead (Revision 2.0, Mar. 25, 2005) and is available from the USGA.

As is best seen in FIG. 3, the striking face 32 defined by the striking wall 30 in the golf club head 10 is substantially coplanar with a virtual striking face plane 64. In cases where the striking face 32 includes a bulge and/or roll (or otherwise is not entirely planar), the virtual striking face plane 64 corresponds to the plane that is tangent to the face center 40 in the manner shown in FIG. 3. A second virtual plane 66 is normal to the striking face plane 64 and passes through the face center 40. The intersection between the second virtual plane 66 and the striking face plane 64 forms a horizontal line 67 that passes through the face center 40. The second virtual plane 66 is coplanar with cross-section 6 of FIG. 3.

Figure 4:
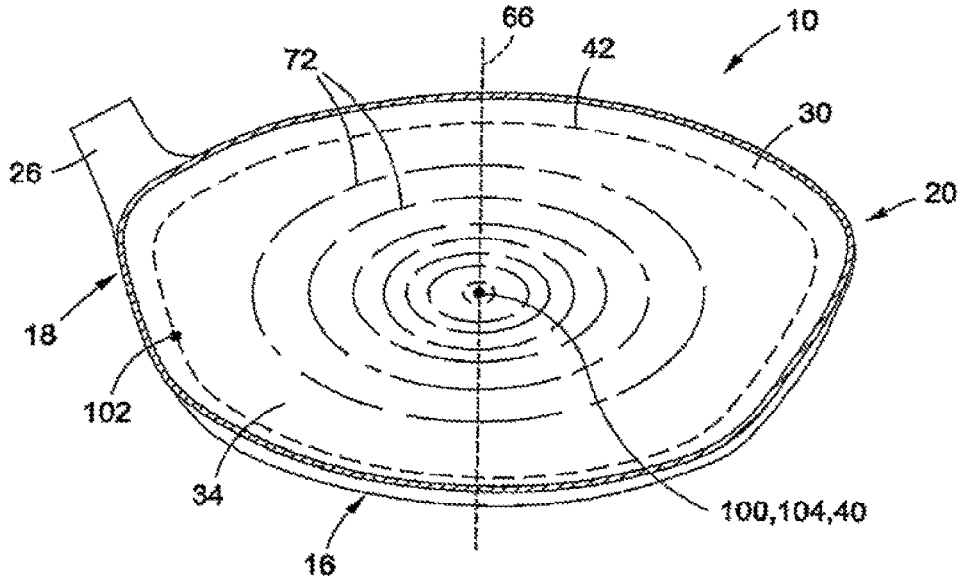
FIG. 4 is a cross-sectional view of the golf club head of FIG. 1 taken along the plane 4-4 of FIG. 3.

Referring to FIG. 4, a portion of the club head 10 is shown in cross-section 4-4 such that the cross-section 4-4 (and in turn the striking face plane 64) is parallel to the plane of the paper. Broken lines 74 are shown that correspond to points on the striking wall 30 that have the same thickness. Thus, the broken lines 74 generally indicate the thickness topography of the striking wall 30. As shown, the rear surface 34 of the striking wall 30 is contoured such that thickness of the striking wall 30 generally increases toward an axis normal to the striking face plane 64 and passing through the face center 40, forming a mound shape. As discussed above, the striking wall 30 includes a striking face 32 opposite of the rear surface 34 that is bounded by a striking face perimeter 42. Also, a first point 104 corresponds to the location, on the striking face 32, associated with the maximum overall striking wall thickness, $t_{max}$. A second point 102, corresponds to a location, on the striking face 32, associated with the minimum overall thickness $t_{min}$ of the striking wall 30.

In some embodiments, $t_{min}$ occurs only at a single point, i.e. the second point 102 and/or $t_{max}$ occurs only at a single point, i.e. the first point 104. However, alternatively, in some embodiments, discrete points each correspond to a same maximum striking wall thickness, $t_{max}$. Similarly, in some embodiments, discrete points correspond to a same minimum overall striking wall thickness, $t_{min}$.

In some embodiments, as shown, the first point 104 is coincident with the face center 40. However, in alternative embodiments, the first point 104 is spaced from the face center 40 by a distance $d_1$ (not shown). Preferably, the first point 104 is spaced from the face center 40 by no more than 6.4 mm, and more preferably no more than 6.35 mm. Most preferably, the distance $d_1$ is within the range of 1 mm to 6.35 mm. In some cases, spacing the location of maximum thickness $T_{max}$ from the face center 40 in the manner described above enables closer alignment of the location of maximum thickness $T_{max}$ with an off-centered center of percussion (i.e. the point of greatest deflection upon golf ball impact), providing for more efficient use of mass in generating a large striking face region of relatively high COR.

Preferably, $t_{max}$ is no less than 4.25 mm, more preferably within the range of 4.30 mm and 5.50 mm, and most preferably within the range of 4.30 mm and 4.60 mm. Alternatively, or in addition, preferably, $t_{min}$ is no greater than 3.0 mm, more preferably no greater than 2.75 mm, even more preferably no greater than 2.50 mm, and most preferably within the range of 2.10 mm and 2.50 mm. Alternatively, or in addition, the ratio $t_{max}/t_{min}$ is preferably no greater than 2.20 and/or no less than 1.70, more preferably no less than 1.75, even more preferably no less than 1.80. These thickness characteristics ensure that maximum COR, as well as the planar size of the region having relatively high COR, is sufficiently increased; however, these preferences also ensure that large steps in wall thickness are avoided, which may associated with the formation of stress concentrations.

In some embodiments, the second point 102, i.e. the location associated with minimum overall striking wall thickness $t_{min}$, coincides with the striking face perimeter 42. Alternatively, in other embodiments, the second point 102 is spaced from the striking face perimeter 42. In such cases, the second point 102 is preferably spaced from the striking face perimeter 42 by a distance $d_2$ that is no greater than 2.00 in., more preferable no greater than 1.50 in, and even more preferably within the range of about 0.05 in. to 1.00 in. By spacing the location of minimum thickness $t_{min}$ from the striking face perimeter 42, as discussed above, the overall distribution of COR over the span of the striking wall 30 could be efficiently manipulated. For example, in some cases, a COR distribution, effected by a specific striking face configuration, that at least in part exceeds USGA regulation could be made to conform to USGA regulation by thickening the striking wall 30 about the perimeter 42 (i.e. relocating the position of minimum thickness $T_{min}$ inward toward a face center 40). Advantageously, in some cases, thickening the region of the striking face 32 proximate the striking face perimeter 42 results in a generally direct shift in COR value over the span of the striking face 32. Thus, a COR distribution of a striking face 32 could be made conforming while any desired relative COR distribution shape could remain intact.

The contour of the rear surface 34 of the striking wall 30 may be further described with reference to one or more thickness profiles. For example, in FIGS. 5 and 5(*a*), a first thickness profile (i.e. a "horizontal" thickness profile) is shown that corresponds to the striking wall 30 when viewed in cross-section 5-5 (see FIG. 3). As another example, in FIGS. 6 and 6(*a*), a second thickness profile is described below that corresponds to the striking wall 30 when viewed in cross-section 6-6 (see FIG. 1).

Referring to FIGS. 5 and 5(*a*), the club head 10 is shown in cross-section 5-5. One of ordinary skill in the art would appreciate that the club head profiles shown in these figures may not be to scale, and may be exaggerated for illustrative purposes. Notably, in this cross-section, thickness varies along the striking wall 30 such that the rear surface contour follows a generally sinusoidal path. The striking face 32 is delimited by, and extends between, the striking face perimeter 42. Specifically, in this plane, the striking face 32 is bounded by points 42(*a*) and 42(*b*), which correspond to the points of intersection between the striking face perimeter 42 and the cross-section 5-5 proximate the toe portion 20 and proximate the heel portion 18, respectively. Specific to the cross-section 5-5, points 42(*a*) and 42(*b*) are spaced by a distance $L_h$. Preferably, $L_h$ is within the range of 3.50 in. and 4.25 in., more preferably between 3.75 in. and 4.0 in., even more preferably within the range of about 3.80 in. and 3.90 in., and most preferably substantially equal to about 3.85 in.

Specific to the cross-section 5-5, a maximum thickness, $t_{max,h}$, is associated with a point on the striking face 32 of the striking wall 30 coincident with the face center 40. However, in alternative embodiments, as discussed above, $t_{max,h}$ may be associated with a point on the striking face 32 (in the cross-section 5-5) that is spaced from the face center 40 by the distance $d_1$ in the manners described above. Specific to the cross-section 5-5, the striking wall 30 includes a minimum thickness, $t_{min,h}$, that is associated with points on the striking face 32 coincident with the striking face perimeter 42(*a*) and 42(*b*). However, in alternative embodiments, the minimum thickness, $t_{min,h}$, specific to the plane 66, is spaced from the striking face perimeter 42(*a*) and/or 42(*b*) by the distance $d_2$ in the manners described above.

Preferably, $t_{max,h}$ is no less than 4.25 mm, more preferably within the range of 4.30 mm and 6.50 mm, even more preferably within the range of 4.30 mm and 5.50 mm, and most preferably within the range of 4.40 mm to 4.60 mm. Alternatively, or in addition, preferably, $t_{min,h}$ is no greater than 3.0 mm, more preferably no greater than 2.75 mm, and even more preferably no greater than 2.50 mm. Alternatively, or in addition, the ratio $t_{max,h}/t_{min,h}$ is preferably no greater than 2.30, and more preferably no greater than 2.20. Additionally, preferably, the ratio $t_{max,h}/t_{min,h}$ is no less than 1.70, more preferably no less than 1.75, and even more preferably no less than 1.80. Configuring the striking wall 30 to exhibit a sufficiently high ratio $t_{max,h}/t_{min,h}$ enables the club head 10 to exhibit high COR. However, limiting the ratio $t_{max,h}/t_{min,h}$ as described above minimizes disparity in COR across the striking wall 30.

Additionally, or alternatively, specific to the cross-section 5-5, the striking wall 30 has a thickness $t_7$ associated with a point on the striking face 32 that is spaced from the face center 40 by a distance no more than $0.16*L_h$ from the face center 40 that is no greater than $0.90*t_{fc}$.

As discussed above, in the plane 66 shown in FIGS. 5 and 5(*a*), the contour of the rear surface 34 of the striking wall 30 follows a generally sinusoidal curve. More specifically, the thickness profile of cross-section 5-5 includes a generally gentle-sloping outer region, a fast-rising middle region circumscribed by the outer region, and a gentle-sloping central region circumscribed by the middle region. Preferably, thickness gradually tapers outwardly of the face center 40. Specifically, the striking wall 30 gradually tapers in thickness from a first location associated with $t_{max,h}$ to a second location associated with $t_{min,h}$. More preferably, the striking wall 30 tapers in thickness entirely from the face center 40 to the striking wall perimeter 42. In other words, preferably, no sharp junctions, kinks, or steps are formed in the thickness profile of section 5-5. Avoiding sharp-angled junctions and steps minimizes the presence of regions generating high stress when the club head 10 impacts a golf ball during use. Nonetheless, in alternative embodiments, one or more steps or sharply-angled junctions may be formed in the thickness profile of section 5-5.

More specifically, exemplary thickness profiles of section 5-5 are shown in Table 1 below. In Table 1, the first row corresponds to various points on the striking face 32 located at equal increments in the heel to toe direction. The second row ("Distance from face center (in)") corresponds to the distance between the various locations, or points, and the face center 40, measured in inches. Positive values correspond to distance increments measured in the heel direction and negative values correspond to distance increments measured in the toe direction, relative to the face center 40.

TABLE 1

| Location | Distance from face center (in) | Distance from the face center (in)/$L_h$ (in) | Example #1-Striking wall thickness (mm) | Example #2-Striking wall thickness (mm) |
|---|---|---|---|---|
| 1 | −1.60 | −0.42 | 2.83 | 2.65 |
| 2 | −1.40 | −0.36 | 2.99 | 2.70 |
| 3 | −1.20 | −0.31 | 3.15 | 2.75 |
| 4 | −1.00 | −0.26 | 3.29 | 2.95 |
| 5 | −0.80 | −0.21 | 3.46 | 3.33 |
| 6 | −0.60 | −0.16 | 3.71 | 3.83 |
| 7 | −0.40 | −0.10 | 4.20 | 4.55 |
| 8 | −0.20 | −0.05 | 4.45 | 4.78 |
| 9 | 0.00 | 0.00 | 4.45 | 4.78 |
| 10 | 0.20 | 0.05 | 4.19 | 4.63 |
| 11 | 0.40 | 0.10 | 3.67 | 3.85 |
| 12 | 0.60 | 0.16 | 3.40 | 3.30 |
| 13 | 0.80 | 0.21 | 3.23 | 3.05 |
| 14 | 1.00 | 0.26 | 3.02 | 2.85 |
| 15 | 1.20 | 0.31 | 2.82 | 2.75 |
| 16 | 1.40 | 0.36 | 2.75 | 2.70 |
| 17 | 1.60 | 0.42 | 2.61 | 2.70 |

The values provided for each of Example #1 and Example #2 represent thicknesses of the striking wall 30 for each respective listed location. The above thickness profiles may alternative be expresses such that thickness is normalized, e.g. as a proportion of $t_{max,h}$. e.g. as shown below in Table 2. In this manner, the provided data more clearly illustrates improvements in the thickness profile of a striking face for maximizing the extent of the region of the striking wall 30 associated with high COR and minimizing regions of high stress during impact

TABLE 2

| Location | Distance from face center (in) | Distance from face center (in)/$L_h$ (in) | Example #1-striking wall thickness (mm)/ $T_{max,h}$ (mm) | Example #2-striking wall thickness (mm)/ $T_{max,h}$ (mm) |
|---|---|---|---|---|
| 1 | −1.60 | −0.42 | 0.64 | 0.55 |
| 2 | −1.40 | −0.36 | 0.67 | 0.56 |
| 3 | −1.20 | −0.31 | 0.71 | 0.58 |
| 4 | −1.00 | −0.26 | 0.74 | 0.62 |
| 5 | −0.80 | −0.21 | 0.78 | 0.70 |
| 6 | −0.60 | −0.16 | 0.83 | 0.80 |
| 7 | −0.40 | −0.10 | 0.94 | 0.95 |
| 8 | −0.20 | −0.05 | 1.00 | 1.00 |
| 9 | 0.00 | 0.00 | 1.00 | 1.00 |
| 10 | 0.20 | 0.05 | 0.94 | 0.97 |
| 11 | 0.40 | 0.10 | 0.82 | 0.81 |
| 12 | 0.60 | 0.16 | 0.76 | 0.69 |
| 13 | 0.80 | 0.21 | 0.73 | 0064 |
| 14 | 1.00 | 0.26 | 0.68 | 0.60 |
| 15 | 1.20 | 0.31 | 0.63 | 0.58 |
| 16 | 1.40 | 0.36 | 0.62 | 0.57 |
| 17 | 1.60 | 0.42 | 0.59 | 0.56 |

In one or more embodiments, a thickness profile of the striking face 32 shown in FIGS. 5 through 5(*b*) may be considered to be comprised of various overlapping topographical regions that each extend about a specific maximum distance from the face center 40. For example, a first topographic region 68 denotes all points, in the cross-section 5-5, and on the striking face 32, that are associated with a first thickness $t_1$ of the striking wall 30 that is no less than $0.92*t_{max,h}$. As shown in FIG. 5(*a*), the first topographic region 68 includes all points along the striking face 32 inclusively between the first endpoint 118 and the second endpoint 120. Preferably, the first topographic region 68 extends from the face center 40 a maximum distance, $d_3$, no greater than $0.13*L_h$. Alternatively, or in addition, the first endpoint 118 and the second endpoint 120 are spaced apart hv a distance $d_6$ no greater than 1.00 in, and more preferably a distance between 0.60 in. and 1.00 in. Alternatively, or in addition, a ratio $d_6/L_h$ is no greater than 0.26 and more preferably within the range of 0.15 to 0.20. These ranges enable the striking wall 30 to effectively bridge thicknesses of $t_{min,h}$ and $t_{max,h}$, as variously described above, without unduly introducing high stress.

Alternatively, or in addition, the thickness profile shown in FIGS. 5 through 5(*b*) defines a second topographical region 70 of the striking face 32 that denotes all points, in the cross-section 5-5, that are associated with a thickness $t_2$ of the striking wall 30 that is no less than $0.87*t_{max,h}$. As shown in FIG. 5(*a*), the second topographic region 70 includes all points along the striking face 32 inclusively between the third endpoint 114 and the fourth endpoint 116. Preferably, the second topographic region 70 extends from the face center 40 a maximum distance, $d_4$, that is also no greater than $0.13*L_h$. Alternatively, or in addition, the third endpoint 114 and the fourth endpoint 116 are preferably spaced apart by a distance $d_7$ no greater than 1.00 in, and more preferably a distance between 0.60 in. and 1.00 in. Alternatively, or in addition, a ratio $d_7/L_h$ is no greater than 0.26 and more preferably within the range of 0.15 to 0.20. These ranges enable the striking wall to effectively bridge thicknesses of $t_{min,h}$ and $t_{max,h}$, as variously described above, without unduly introducing high stress.

Alternatively, or in addition, the thickness profile shown in FIGS. 5 through 5(*b*) defines a third topographical region 72 of the striking face 32 that denotes all points, in the cross-section 5-5, that are associated with a thickness $t_3$ of the striking wall 30 that is no less than $0.80*t_{max,h}$. As shown in FIG. 5(*a*), the third topographic region 72 includes all points along the striking face 32 inclusively between the fifth endpoint 110 and the sixth endpoint 112. Preferably, the third topographic region 72 extends from the face center 40 a maximum distance, $d_5$, that is no greater than $0.26*L_h$. Alternatively, or in addition, the fifth endpoint 110 and the sixth endpoint 112 are preferably spaced apart by a distance $d_8$ no greater than 1.40 in., and more preferably a distance between 1.00 in. and 1.40 in. Alternatively, or in addition, a ratio $d_8/L_h$ is no greater than 0.37 and more preferably within the range of 0.25 to 0.37. These ranges enable the striking wall to effectively bridge thicknesses of $t_{min,h}$ and $t_{max,h}$, as variously described above, without unduly introducing high stress.

Additionally, or alternatively, the striking wall 30 has a first thickness $t_{fc}$ associated with the face center 40 that is no less than 4.25 mm and a second thickness associated with a point on the striking face 32 that is spaced from the face center 40 by a distance no more than $0.16*L_h$ from the face center 40 that is no greater than $0.90*t_{fc}$. By configuring the striking face 32 of club head 10 in at least some of the manners described above, an advantageous COR profile may result.

In some embodiments, a first COR value $COR_1$, measured at the face center 40, is less than at least a second COR value $COR_2$, measured at a location spaced from the face center 40. In other words, COR preferably increases outwardly of the face center 40, at least in the cross-section 5-5. Further, preferably, the COR value $COR_2$ is associated with a location heelward of the face center 40. However, in some embodiments, COR is greater than at the face center 40 at locations that are heelward of, and toeward of, the face center 40.

The value $COR_1$ is preferably less than 0.830, but preferably no less than 0.825, and even more preferably within the range of 0.825 to 0.828. These values provide for maximum golf ball flight distances when the striking face 32 impacts a golf ball generally at the face center 40. Additionally, or alternatively, $COR_2$, measured at a second location on the striking face 32 that is spaced from the face center 40, is preferably no less than $COR_1$, and more preferably greater than $COR_1$. More preferably, the second location is spaced from the face center 40 by a distance no less than 0.15 in. and $COR_2$ is greater than $COR_1$ by no less than 0.002. More preferably, $COR_2$ is greater than $COR_1$ by no less than 0.004 and measured at a second location spaced from the face center 40 by a distance between 0.175 in and 0.225 in. Additionally, or alternatively, the striking wall thickness associated with the location at which $COR_2$ is measured is no greater than 4.0 mm. In some embodiments, in the cross-section 5-5, $COR_1$ corresponds to a local minimum COR value. Additionally, or alternatively, the location of $COR_2$ is spaced from the face center 40 by a distance no greater than 12.7 mm. The above configurations enable the club head 10 to have elevated performance while still conforming to USGA regulations and maintaining stress throughout the striking wall at a level not likely to cause failure (e.g. 200 ksi).

Recently, for various reasons, the USGA has fumed to characteristic time (CT) as a means to quantifying the flexibility of a golf club head striking face, in place of COR. The method for determining CT of a club head is described, e.g., in the United States Golf Association Procedure for Measuring the Flexibility of a Golf Clubhead, Revision 1.0.0 (May 1, 2008). Although COR and CT may not be analogous measurements in all cases, for all practical purposes herein, any described COR value or change in COR corresponds to a CT value or change in CT value in accordance with the following formula:

$$\text{CT value(microseconds)}=(\text{COR value}-0.718)/0.000436$$

As discussed above, significant advantages are realized by configuring the striking face 32 of the club head 10 to have a thickness profile as shown and described with regard to the cross-section 5-5. Specifically, a relatively high thickness gradient may be realized, without generating high stress regions, by configuring the thickness profile to follow an accentuated bell curve. More specifically, regions of high stress may be minimized by configuring the thickness of the striking face 32 such that the rear surface 34 of the striking face 32 follows a sinuous path, in which thickness gradually tapers generally from a central location to an outward location.

Preferably, the thickness profile of striking wall 30, as variously described above with regard to cross-section 5-5, is provided in the striking wall 30 in other imaginary cross-sectional planes that are perpendicular to the striking face plane 64 and that pass through the face center 40. For example, referring to FIG. 1, the cross-sectional plane 6-6 is vertical relative to the ground plane 36, and passes through the face center 40. The golf club head 10 is shown in this cross-section 6-6 in FIG. 6.

Figure 6:
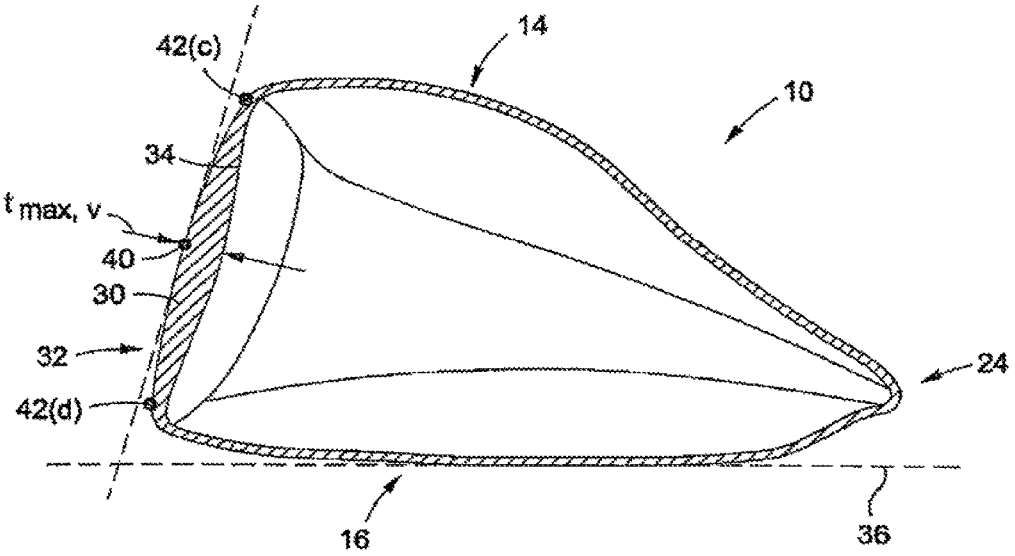
FIG. 6 is a cross-sectional view of the golf club head of FIG. 1 taken along the cross-section 6-6 of FIG. 1.
Figure 6A:
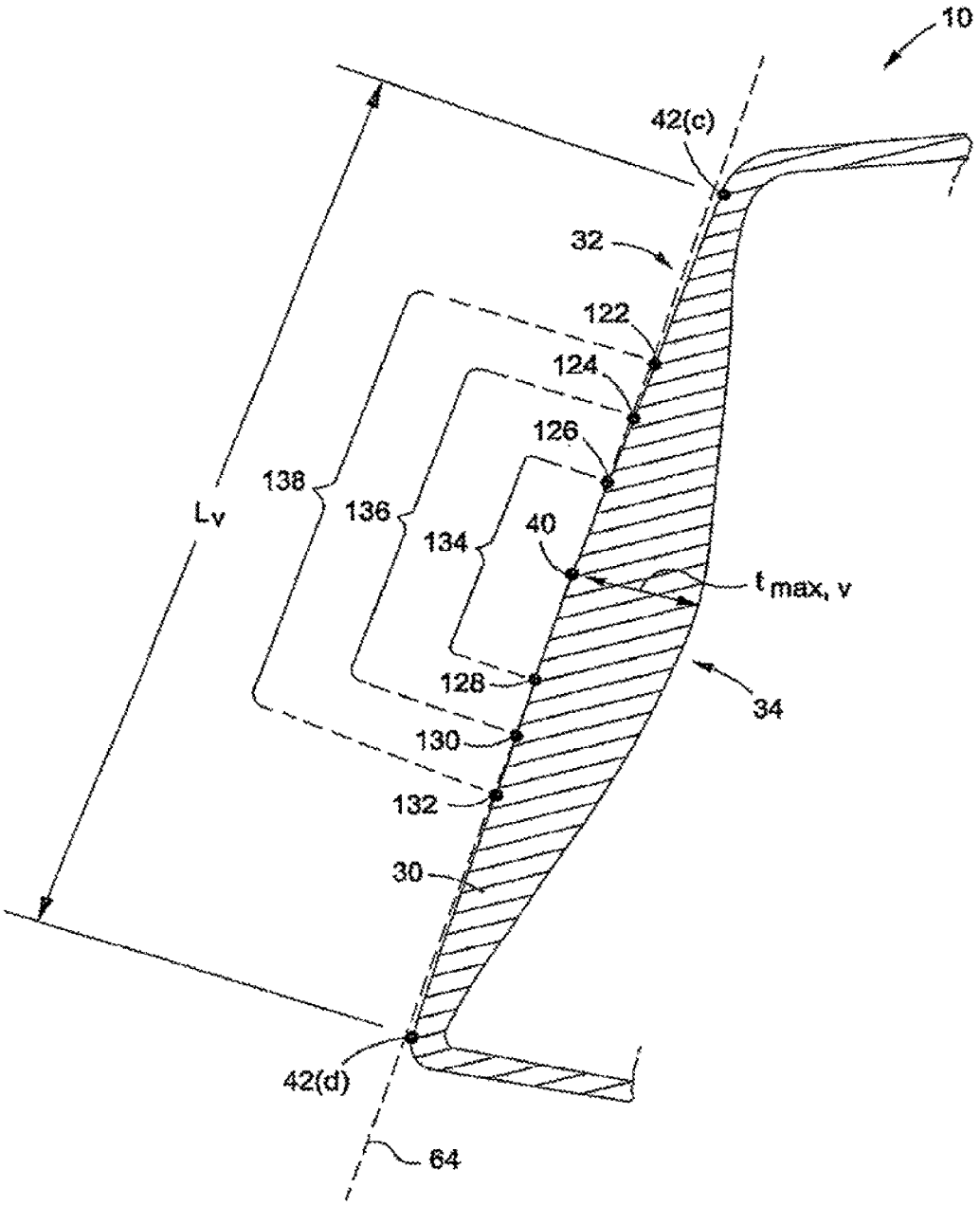
Figure 6B:
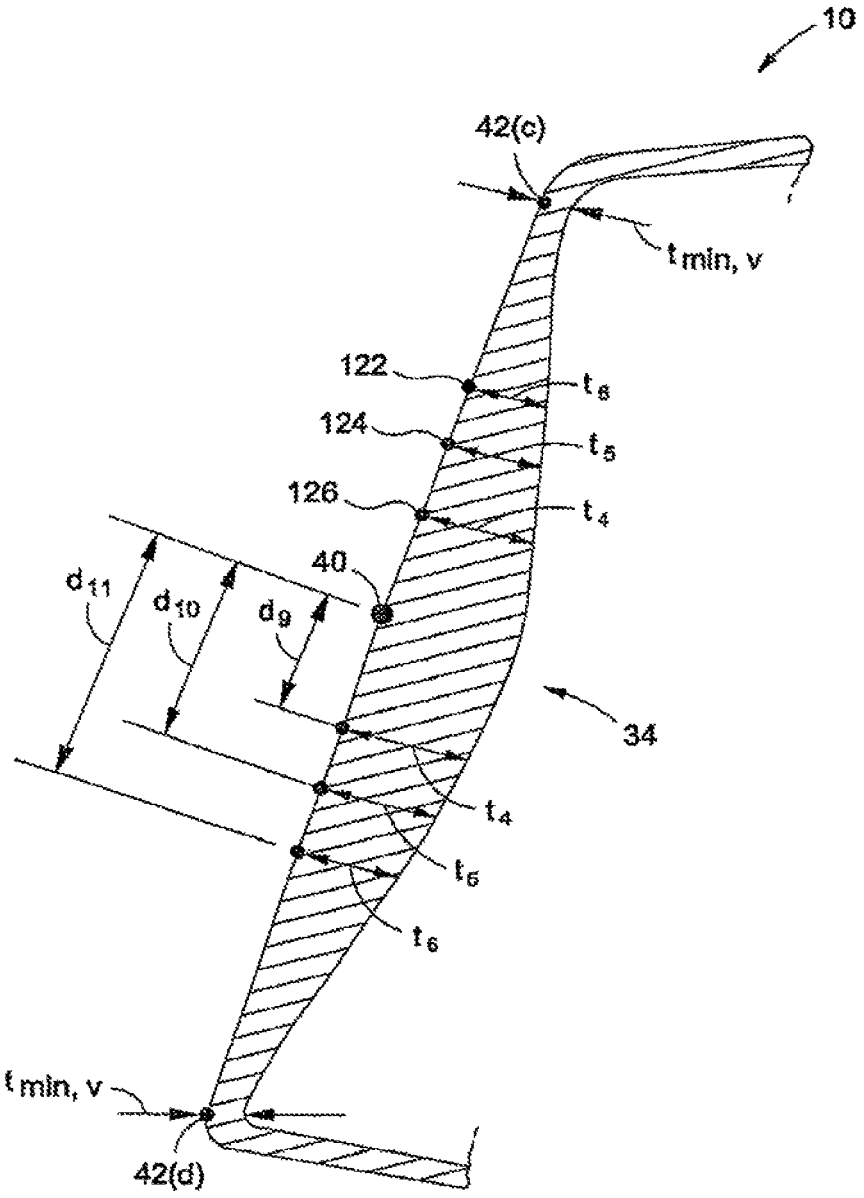

Referring to FIG. 6, the golf club head 10 includes the striking wall 30 which includes a striking face 32 and a rear surface 34 opposite the striking face 32. The striking face 32 includes a roll of a conventional radius (e.g. a radius within the range of about 9 in. to about 15 in.). The striking face 32 includes a face center 40 as described above and terminates in a striking face perimeter 42. The imaginary striking face plane 64 is tangent to the face center 40. The striking face perimeter 42 intersects with the cross-sectional plane 6-6 to form a first point 42(*c*) proximate the top portion 14 and a second point 42(*d*) proximate the bottom portion 16.

Referring to FIGS. 6 through 6(*b*), the club head 10 is shown in cross-section 6-6, i.e. a vertical cross-section through the face center 40. One of ordinary skill in the art would appreciate that the club head thickness profiles shown in these figures may not be to scale, and may be exaggerated for illustrative purposes. Notably, in this cross-section, thickness varies along the striking wall 30 such that the contour of the rear surface 34 follows a generally sinusoidal path.

Referring specifically to FIG. 6(*a*), striking face perimeter points 42(*c*) and 42(*d*) are spaced by a distance $L_v$. Preferably, $L_v$ is within the range of 2.00 in. and 3.00 in., more preferably between 2.25 in. and 2.75 in., even more preferably within the range of about 2.40 in. and 2.50 in., and most preferably equal to about 2.45 in.

Referring to FIG. 6(*a*), specific to the cross-section 6-6, a maximum thickness, $t_{max,v}$, is associated with a point on the striking face 32 of the striking wall 30 coincident with the face center 40. However, in alternative embodiments, as discussed above, $t_{max,v}$ may be associated with a point on the striking face 32 (in the plane 6-6) that is spaced from the face center 40 by the distance similar in quantity to distance $d_1$, as variously described above. Specific to the cross-section 6-6, the striking wall 30 includes a minimum thickness, $t_{min,v}$, that is associated with points on the striking face 32 coincident with the striking face perimeter 42(*c*) and 42(*d*). However, in alternative embodiments, the minimum thickness, $t_{min,v}$, is spaced from the striking face perimeter 42(*c*) and/or 42(*d*) by a distance similar to distance $d_2$, as variously described above.

Preferably, $t_{max,v}$ is no less than 4.20 mm, more preferably no less than 4.25 mm, even more preferably within the range of 4.35 mm to 5.00 mm, and most preferably within the range of 4.30 mm to 4.60 mm. Alternatively, or in addition, preferably, $t_{min,v}$ is no greater than 2.85 mm, more preferably no greater than 2.75 mm, even more preferably no greater than 2.50 mm, and most preferably within the range of 2.40 mm and 2.70 mm. Alternatively, or in addition, tile ratio $t_{max,v}/t_{min,v}$ is preferably no greater than 2.30, more preferably no greater than 2.20. Additionally, or alternatively, the ration $t_{max,v}/t_{min,v}$ is preferably no less than 1.70, more preferably no less than 1.75, even more preferably within the range of 1.75 to 2.20, and most preferably within the range of 1.75 to 2.0. Configuring the striking wall 30 to exhibit a sufficiently high ratio $t_{max,v}/t_{min,v}$ enables the club head 10 to exhibit high COR. However, limiting the ratio $t_{max,v}/t_{min,v}$ as described above minimizes disparity in COR across the striking wall 30.

As discussed above, in the cross-section 6-6 shown in FIGS. 6 and 6(*a*), the contour of the rear surface 34 of the striking wall 30 follows a generally sinusoidal curve. More specifically, the thickness profile of cross-section 6-6 includes a generally gentle-sloping outer region, a fast-rising middle region, and a gentle-sloping central region. Preferably, thickness gradually tapers outwardly of the face center 40. In other words, preferably, no sharp junctions, kinks, or steps are formed in the thickness profile of section 6-6. Avoiding sharp-angled junctions and steps minimizes the extent of regions generating high stress when the club head 10 impacts a golf ball during use. Nonetheless, in alternative embodiments, one or more steps or sharply-angled junctions may be formed in the thickness profile of section 6-6.

More specifically, exemplary thickness profiles of section 6-6 are shown in Table 3 below. In Table 3, the first row corresponds to various points on the striking face 32 located at equal increments in the bottom to top direction. The second row ("Distance from face center (in.)") corresponds to the distance between the various locations, or points, and the face center 40, measured in inches. Positive values correspond to distance increments measured upward of the face center 40 and negative values correspond to distance increments measured downward of the face center 40.

TABLE 3

| Location | Distance from face center (in.) | Distance from face center (in.)/$L_v$ (in.) | Example #1-Striking wall thickness (mm) | Example #2-Striking wall thickness (mm) |
|---|---|---|---|---|
| 1 | −1 | −0.41 | 2.55 | 2.60 |
| 2 | −0.8 | −0.33 | 2.75 | 2.70 |
| 3 | −0.6 | −0.24 | 3.12 | 2.90 |
| 4 | −0.4 | −0.16 | 3.53 | 3.65 |
| 5 | −0.2 | −0.08 | 4.17 | 4.70 |
| 6 | 0 | 0.00 | 4.45 | 4.78 |
| 7 | 0.2 | 0.08 | 4.17 | 4.65 |
| 8 | 0.4 | 0.16 | 3.58 | 1.70 |
| 9 | 0.6 | 0.24 | 3.30 | 3.10 |
| 10 | 0.8 | 0.33 | 3.16 | 2.80 |
| 11 | 1 | 0.41 | 3.06 | 2.75 |

The values provided for each of Example #1 and Example #2 represent thicknesses of the striking wall 30 for each respective listed location. The above thickness profiles may alternative be expresses such that thickness is normalized, e.g. as a proportion of $t_{max,v}$ as shown below in Table 4. In this manner, the provided data more clearly illustrates improvements in the thickness profile of a striking face for maximizing the extent of the region having relatively high COR and minimizing regions of high stress during impact.

TABLE 4

| Location | Distance from face center (in.) | Distance from face center (in.)/ $L_v$ (in.) | Example #1-Striking wall thickness (mm)/ $t_{max,v}$ (mm) | Example #2-Striking wall thickness (mm)/ $t_{max,v}$ (mm) |
|---|---|---|---|---|
| 1.00 | −1 | −0.41 | 0.57 | 0.54 |
| 2.00 | −0.8 | −0.33 | 0.62 | 0.56 |
| 3.00 | −0.6 | −0.24 | 0.70 | 0.61 |
| 4.00 | −0.4 | −0.16 | 0.79 | 0.76 |
| 5.00 | −0.2 | −0.08 | 0.94 | 0.98 |
| 6.00 | 0 | 0.00 | 1.00 | 1.00 |
| 7.00 | 0.2 | 0.08 | 0.94 | 0.97 |
| 8.00 | 0.4 | 0.16 | 0.80 | 0.77 |
| 9.00 | 0.6 | 0.24 | 0.74 | 0.65 |
| 10.00 | 0.8 | 0.33 | 0.71 | 0.59 |
| 11.00 | 1 | 0.41 | 0.69 | 0.95 |

In addition, or alternatively, to the cross-sectional thickness profile described above, the thickness profile of the stri king face 32 shown in FIGS. 6 through 6(*b*) comprises various overlapping topographical regions that each extend about a specific maximum distance from the face center 40. For example, a fourth topographic region 134 denotes all points, in the cross-section 6-6, on the striking face 32, that are associated with a fourth thickness $t_4$ of the striking wall 30 that is no less than $0.92*t_{max,v}$. As shown in FIG. 6(*a*), the fourth topographic region 134 includes all points along the striking face 32 inclusively between a ninth endpoint 126 and a tenth endpoint 128. Preferably, the fourth topographic region 134 extends from the face center 40 a maximum distance, $d_9$, no greater than $0.13*L_v$. Alternatively, or in addition, the ninth endpoint 126 and the tenth endpoint 128 are preferably spaced apart by a distance $d_{12}$ no greater than 1.00 in, and more preferably between 0.60 in. and 1.00 in. Alternatively, or in addition, a ratio $d_{12}/L_h$ is no greater than 0.26 and more preferably within the range of 0.15 to 0.20. These ranges enable the striking wall to effectively bridge thicknesses of $t_{min,v}$ and $t_{max,v}$, as variously described above, without unduly introducing high stress.

Alternatively, or in addition, the thickness profile shown in FIGS. 6 through 6(*b*) defines a fifth topographical region 136 of the striking face 32 that denotes all points, in the cross-section 6-6, that are associated with a thickness $t_5$ of the striking wall 30 that is no less than $0.87*t_{max,v}$. As shown in FIG. 6(*a*), the second topographic region 136 includes all points along the striking face 32 inclusively between an eighth endpoint 124 and an eleventh endpoint 130. Preferably, the fifth topographic region 136 extends from the face center 40 a maximum distance, $d_{10}$, that is also no greater than $0.13*L_v$. Alternatively, or in addition, the eighth endpoint 124 and the eleventh endpoint 130 are spaced apart by a distance $d_{13}$ no greater than 1.00 in, and more preferably a distance between 0.60 in. and 1.00 in. Alternatively, or in addition, a ratio $d_{13}/L_v$ is no greater than 0.40 and more preferably within the range of 0.20 to 0.35. These ranges enable the striking wall to effectively bridge thicknesses of $t_{min,v}$ and $t_{max,v}$, as variously described above, without unduly introducing high stress.

Alternatively, or in addition, the thickness profile shown in FIGS. 6 through 6(*b*) defines a sixth topographical region 138 of the striking face 32 that denotes all points, in the cross-section 6-6, that are associated with a thickness $t_6$ of the striking wall 30 that is no less than $0.80*t_{max,v}$. As shown in FIG. 6(*a*), the third topographic region 138 includes all points along the striking face 32 inclusively between the seventh endpoint 122 and the twelfth endpoint 132. Preferably, the sixth topographic region 138 extends from the face center 40 a maximum distance, $d_{11}$, that is no greater than $0.26*L_v$. Alternatively, or in addition, the seventh endpoint 122 and the twelfth endpoint 132 are preferably spaced apart by a distance $d_{14}$ no greater than 1.20 in., and more preferably a distance between 0.60 in. and 1.00 in. Alternatively, or in addition, a ratio $d_{14}/L_v$ is no greater than 0.37 and more preferably within the range of 0.25 to 0.37. These ranges enable the striking wall to effectively bridge thicknesses of $t_{min,v}$ and $t_{max,v}$, as variously described above, without unduly introducing high stress.

In some embodiments, preferably, the thickness profile, as variously characterized with regard to the cross-section 5-5 shown in FIGS. 5 through 5(*b*), is also provided in other imaginary cross-sections that are perpendicular to the striking face plane 64 and pass through the face center 40. For example, the presence and extents of the topographical regions of FIG. 5(*b*) are preferably also provided in imaginary cross-sections in addition to the cross-section 6-6. Preferably, the characteristics of the variously-described topographic regions 68, 70, and 72 of cross-section 5-5 form a majority proportion of all cross-sections perpendicular to the striking face plane 64 and passing through the face center 40. More preferably, all imaginary cross-sections perpendicular to the striking face plane 64 and passing through the face center 40 fall within the topographic dimension ranges described with regard to the thickness profile of FIG. 5(*b*).

Figure 7:
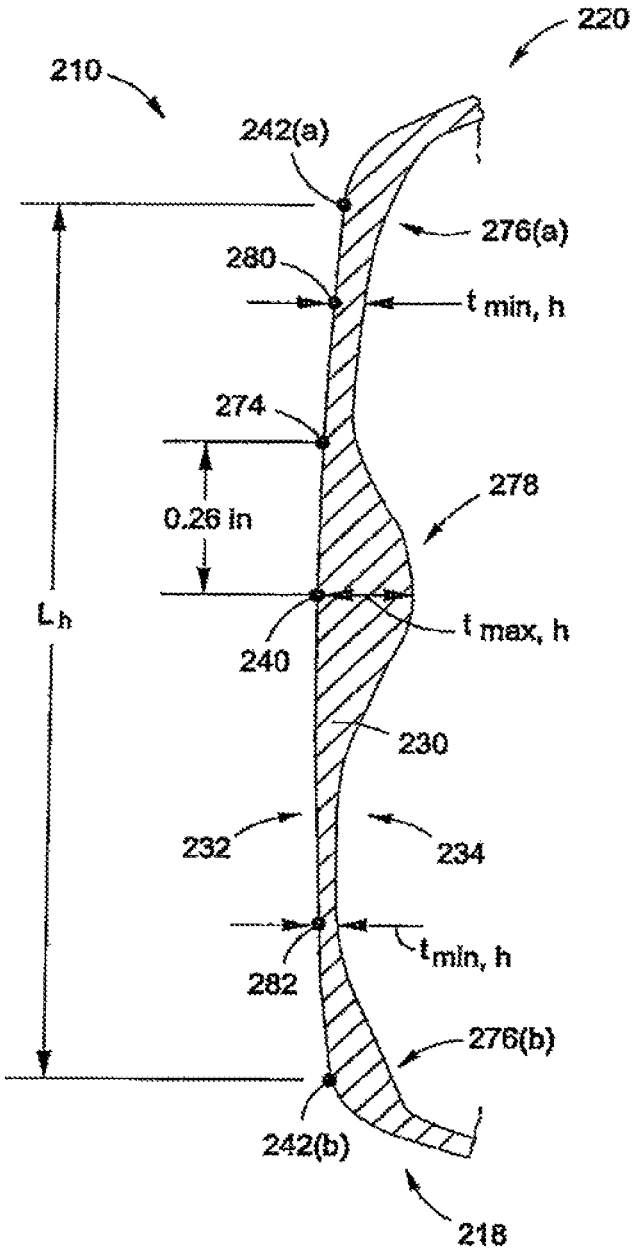
FIG. 7 is a partial cross-sectional view of another embodiment of the golf club head of FIG. 1, taken in the plane 5-5.

In one or more embodiments, as shown in FIG. 7, an alternative striking wall 232 is formed of non-uniform thickness. The striking wall 232 is shown through cross-section 5-5 (shown in FIG. 3) such that a contour of the rear surface 234 forms an accentuated bell curve in a central region 278 proximate the face center 240. The contour of the rear surface 234 also includes a first flared portion 276(*a*) outward of the central region 278 and proximate the toe portion 220, and a second flared portion 276(*b*) outward of the central region 278 and proximate the heel portion 218. Preferably, the striking wall 230 of the club head 210 shown in FIG. 7 includes topographic regions that are similarly dimensioned to the first, second, and third topographic regions 68, 70, and 72 described with regard to the striking wall 30 shown in FIG. 5. However, in the club head 210 shown in FIG. 7, a point 280 associated with a minimum striking face thickness in the plane 5-5, $T_{min,h}$, is substantially spaced from the striking face perimeter 242(*a*) and 242(*b*) in the cross-section 5-5. Preferably, a minimum distance between either of points 280 and 282 (associated with $T_{min,h}$) and the striking face perimeter 242(*a*) and 242(*b*) is no less than 0.20 in., more preferably no greater than 2.0 in., even more preferably within the range of 0.40 in. and 1.50 in., and most preferably within the range of 0.40 in. and 1.00 in.

By spacing the location of minimum thickness $T_{min}$ from the striking face perimeter 242, as discussed above, the overall distribution of COR over the span of the striking wall 230 could be efficiently manipulated. For example, in some cases, a COR distribution, effected by a specific striking face configuration, that at least in part exceeds USGA regulation could be made to conform to USGA regulation by thickening the striking wall 230 about the perimeter 242 (i.e. relocating the position of minimum thickness $T_{min,h}$ inward toward a face center 40). Advantageously, in some cases, thickening the region of the striking face 232 proximate the striking face perimeter 242 results in a generally direct shift in COR value over the span of the striking face 232. Thus, a COR distribution of a striking face 232 could be made conforming while any desired relative COR distribution shape could remain intact.

Additionally, or alternatively, the central region 278 of the striking wall 230 of the club head 210, in the cross-section 5-5, has thicknesses corresponding to various locations as shown in Table 5 below. Negative distance values indicate distances measured in the toeward direction. Positive distance values indicate distances measured in the heelward direction.

TABLE 5

| Location | Distance from face center (in.) | Distance from face center (in.)/ $L_h$ (in.) | Example #3-striking wall thickness (mm) | Example #3-striking wall thickness (mm)/ $T_{max,h}$ (mm) |
|---|---|---|---|---|
| 1 | −1.6 | −0.42 | 2.73 | 0.57 |
| 2 | −1.4 | −0.36 | 2.72 | 0.57 |
| 3 | −1.2 | −0.31 | 2.88 | 0.60 |
| 4 | −1 | −0.26 | 3.04 | 0.63 |
| 5 | −0.8 | −0.21 | 3.36 | 0.70 |
| 6 | −0.6 | −0.16 | 3.68 | 0.77 |
| 7 | −0.4 | −0.10 | 4.55 | 0.95 |
| 8 | −0.2 | −0.05 | 4.80 | 1.00 |
| 9 | 0 | 0.00 | 4.80 | 1.00 |
| 10 | 0.2 | 0.05 | 4.54 | 0.95 |
| 11 | 0.4 | 0.10 | 3.64 | 0.76 |
| 12 | 0.6 | 0.16 | 3.15 | 0.66 |
| 13 | 0.8 | 0.21 | 2.96 | 0.62 |

TABLE 5-continued

| Location | Distance from face center (in.) | Distance from face center (in.)/ $L_h$ (in.) | Example #3-striking wall thickness (mm) | Example #3-striking wall thickness (mm)/ $T_{max,h}$ (mm) |
|---|---|---|---|---|
| 14 | 1 | 0.26 | 2.75 | 0.57 |
| 15 | 1.2 | 0.31 | 2.72 | 0.57 |
| 16 | 1.4 | 0.36 | 2.70 | 0.56 |
| 17 | 1.6 | 0.42 | 2.56 | 0.53 |

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. A wood-type golf club head comprising:

a main body; and a striking wall associated with the main body, the striking wall having a striking face including a face center, a first imaginary plane tangent to the face center, and a rear surface opposite the striking face, wherein, in a second imaginary plane perpendicular to the first imaginary plane and passing through the face center:

the striking face includes, specific to the second imaginary plane, a first point associated with a maximum thickness, $t_{max}$, of the striking wall, and a second point associated with a minimum thickness, $t_{min}$, of the striking wall, such that a ratio, $t_{max}/t_{min}$, is no less than 1.70, the first point generally coincident with the face center; and the striking wall gradually tapers in thickness entirely from the first point to the second point.

2. The golf club head of claim 1, wherein at least a portion of the main body is formed of a material having an elongation of at least about 10%.

3. The golf club head of claim 1, wherein the ratio, $t_{max}/t_{min}$, is no less than 1.75.

4. The golf club head of claim 1, wherein the ratio, $t_{max}/t_{min}$, is no less than 1.80.

5. The golf club head of claim 1, wherein the minimum thickness, $t_{min}$, is no greater than 2.75 mm.

6. The golf club head of claim 5, wherein the minimum thickness $t_{min}$ is no greater than 2.50 mm.

7. The golf club head of claim 1, wherein a first coefficient of restitution value, measured at the lace center, is less than 0.83, and a second coefficient of restitution value, measured at a striking face location spaced from the face center, is greater than the first coefficient of restitution value.

8. The golf club head of claim 1, wherein, in the second imaginary plane, the thickness of the striking wall gradually tapers entirely from the face center to the striking face perimeter.

9. A wood-type golf club head comprising:

a main body; and a striking wall associated with the main body, the striking wall having a striking face including a face center, a first imaginary plane tangent to the face center, and a rear surface opposite the striking face, wherein, in a second imaginary plane perpendicular to the first imaginary plane and passing through the face center:

the striking face includes, specific to the second imaginary plane, a first point associated with a maximum thickness, $t_{max}$, of the striking wall, and a second point associated with a minimum thickness, $t_{min}$, of the striking wall, such that a ratio, $t_{max}/t_{min}$, is no less than 1.70, the first point generally coincident with the face center; and the striking wall gradually tapers in thickness entirely from the first point to the second point; and wherein an intersection between the first imaginary plane and the second imaginary plane forms a horizontal line when the club head is oriented in a reference position.

10. The golf club head of claim 9, wherein at least a portion of the main body is formed of a material having an elongation of at least about 10%.

11. The golf club head of claim 9, wherein the ratio, $t_{max}/t_{min}$, is no less than 1.75.

12. The golf club head of claim 9, wherein the minimum thickness, $t_{min}$, is no greater than 2.75 mm.

13. The golf club head of claim 9, wherein a first coefficient of restitution value, measured at the face center, is less than 0.83, and a second coefficient of restitution value, measured at a striking face location spaced from the face center, is greater than the first coefficient of restitution value.

14. The golf club head of claim 9, wherein, in the second imaginary plane, the thickness of the striking wall gradually tapers entirely from the face center to the striking face perimeter.

15. A wood-type golf club head comprising;

a main body; and a striking wall associated with the main body, the striking wall having a striking face including a face center, a first imaginary plane tangent to the face center, and a rear surface opposite the striking face;

wherein, in a second imaginary plane perpendicular to the first, imaginary plane and passing through the face center:

the striking face includes, specific to the second imaginary plane, a first point associated with a maximum thickness, $t_{max}$, of the striking wall, and a second point associated with a minimum thickness, $t_{min}$, of the striking wall, such that a ratio, $t_{max}/t_{min}$, is no less than 1.70, the maximum thickness, $t_{max}$, being no less than 4.25 mm, the first point generally coincident with the face center; and the striking wall gradually tapers in thickness entirely from the first point to the second point.

16. The golf club head of claim 15, wherein at least a portion of the main body is formed of a material having an elongation of at least about 10%.

17. The golf club head of claim 15, wherein the ratio, $t_{max}/t_{min}$, is no less than 1.75.

18. The golf club head of claim 15, wherein the minimum thickness, $t_{min}$, is no greater than 2.75 mm.

19. The golf club head of claim 15, wherein a first coefficient of restitution value, measured at the face center, is less than 0.83, and a second coefficient of restitution value, measured at a striking face location spaced from the face center, is greater than the first coefficient of restitution value.

20. The golf club head of claim 15, wherein, in the second imaginary plane, the thickness of the striking wall gradually tapers entirely from the face center to the striking face perimeter.

* * * * *